US006764156B2

(12) United States Patent
Mantell

(10) Patent No.: US 6,764,156 B2
(45) Date of Patent: Jul. 20, 2004

(54) HEAD SIGNATURE CORRECTION IN A HIGH RESOLUTION PRINTER

(75) Inventor: David A. Mantell, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/735,166

(22) Filed: Dec. 12, 2000

(65) Prior Publication Data

US 2002/0070993 A1 Jun. 13, 2002

(51) Int. Cl.[7] ..... B41J 29/393
(52) U.S. Cl. ..... 347/14; 347/19
(58) Field of Search ..... 347/8, 9, 12, 14, 347/16, 19

(56) References Cited

U.S. PATENT DOCUMENTS 4,328,504 A * 5/1982 Weber et al. ..... 347/19
4,509,057 A * 4/1985 Sohl et al. ..... 347/19
4,626,867 A * 12/1986 Furukawa et al. ..... 347/19
4,847,638 A * 7/1989 Moriyama ..... 347/16
5,128,691 A * 7/1992 Millet et al. ..... 347/19
5,212,497 A * 5/1993 Stanley et al. ..... 347/19
5,477,244 A * 12/1995 Shibata et al. ..... 347/19
5,576,744 A * 11/1996 Niikura et al. ..... 347/14
5,847,724 A 12/1998 Mantell ..... 347/15
5,923,344 A * 7/1999 Norum et al. ..... 347/9
6,168,261 B1 * 1/2001 Miyake et al. ..... 347/19
6,273,542 B1 * 8/2001 Couwenhoven et al. ..... 347/19
6,367,903 B1 * 4/2002 Gast et al. ..... 347/9

* cited by examiner

*Primary Examiner*—Lamson Nguyen
*Assistant Examiner*—Blaise Mouttet
(74) *Attorney, Agent, or Firm*—Fay, Sharpe, Fagan, Minnich & McKee, LLP

(57) ABSTRACT

An image forming system and an associated method for correcting ink droplet placement errors across a printhead. By creating an ink droplet characterization of the printhead, the image forming system is able to time the firing of printhead ink ejectors to avoid drop placement errors caused by ink ejector velocity variations or printhead alignment errors.

3 Claims, 4 Drawing Sheets

HEAD SIGNATURE CORRECTION IN A HIGH RESOLUTION PRINTER

TECHNICAL FIELD OF THE INVENTION

The present invention generally relates to image forming systems, and more particularly, relates to a highly addressable image forming system employing a printhead.

BACKGROUND ON THE INVENTION

There are a number of different image forming systems in use today for generating images on a print medium. For example, one of those systems employs focused acoustic energy to eject droplets of marking material, such as ink, from a printhead onto a recording medium. This type of system utilizes printing technology known as acoustic ink printing (AIP) systems.

Printheads utilized in AIP systems most often include a plurality of droplet ejectors, each of which emits a converging acoustic beam into a pool of fluid, e.g., ink. The angular convergence of this beam is selected such that the beam focuses at or near the free surface of the ink, such as at the border between the ink and air. Printing is executed by modulating the radiation pressure that the beam of each ejector exerts against the free surface of ink to selectively eject droplets of ink from the free surface.

In addressable image forming systems that utilize a printhead, such as the AIP printhead discussed above, systematic placement errors can occur in ink droplets. While some errors are random errors, many are repeatable. These systematic placement errors may be caused by manufacturing defects in the printhead or printhead alignment errors, which may result in, drop directionality errors or drop velocity errors. For example, straight vertical lines may look wavy, or in a color image, intercolor bleed is a consequence of ink drop placement errors. Ink droplet placement errors are especially noticeable in an image forming system that employs a bi-directional printhead. This is because a bi-directional printhead ejects ink droplets in opposing directions with each pass across the imaging medium; hence, the ink droplet placement errors are compounded due to opposing printhead directions. As a result of ink droplet placement errors across a printhead, the imaging quality and resolution of a high addressability system, such as an acoustic ink system does not necessarily match the imaging capability of the system.

SUMMARY OF THE INVENTION

While some drop position errors are random errors, many of the drop position errors can be predicted and partially corrected in a highly addressable system. One particularly important source of such errors are variations in drop velocity across a printhead. Variations in velocity cause drops from one nozzle to land on the paper sooner than drops from another nozzle. As a consequence, objects, such as lines in the image are more ragged and/or angled differently than intended. These velocity variations can be caused by manufacturing variations in ejector nozzle shape or size. Variability in the ejector shape or size can also result in directionality errors that can cause ink droplet position errors on the imaging media.

An additional cause of ink drop position errors is printhead alignment errors, such as printhead tilt. The amount a printhead tilts into or out of the imaging medium causes differences in the amount of time ink drops take to reach the medium from one end of the printhead to another.

In some instances, ink drop placement variations vary from one page to another due to factors outside of the printhead such as, the thickness of the media. For example, thicker media reduces the amount of time for drops to reach the page and thus the compensation for velocity dependent errors will change. Other factors that cause ink drop placement variations may be transient such as, thermal effects or other variations in the image forming system or within the printhead itself. As long as ink drop placement variations caused by these transient effects are predictable, they can be corrected.

The present invention addresses the above-described ink droplet placement problems across a printhead. In particular, the present invention provides a method for correcting systematic drop position errors in the highly addressable direction. For example, intercolor bleed and wavy lines caused by ink droplet placement errors can be greatly reduced.

In one embodiment of the present invention, a method is performed in an image forming system that discharges ink droplets from the printhead onto an imaging medium to create an image. Once the image is created, differences between a parameter of a first ink droplet and a parameter of a second ink droplet are measured. The parametric measurement of selected ink droplets, such as ink droplet distance from a target point, parallelism between a first ink droplet and a second ink droplet, or a dimensional analysis of the ink droplet on the image medium, is used to derive an ink droplet compensation value for each ink droplet. Once the ink droplet parameters have been measured and the ink droplet velocity compensation values derived, a data file, such as a look-up table that holds the ink droplet compensation values, is created and stored on a storage element. For example, the storage element may be a local hard drive, a semiconductor storage device, such as a RAM device, or as a file on a remote database. A processor utilizes the look-up table to regulate, e.g., to advance or retard, ink droplet discharge from the addressable printhead in order to correct for ink droplet placement errors. In addition, the ink droplet compensation values in the look up table may be adjusted by the user to accommodate for changes in the printing conditions, such as thickness variations in the different imaging media utilized by the image forming system.

The above described approach benefits image forming systems having a highly addressable system. For example, a printhead with a nozzle density of 600 nozzles per inch can fire up to five drops per nozzle per pixel in one printhead scan direction, to produce up to three thousand ink drops per inch. Printhead resolutions equal to or greater than 1200 positions per inch are necessary to make adequate correction possible. It is preferred that the 1200 positions per inch resolution occurs in a single processes direction to insure that corrections are associated with individual ejectors.

Another example would be a 600 dpi printhead that is used to print a 1200×1200 dpi image in two or more passes. On each pass the appropriate correction factor is applied to each ejector to correct for position errors associated with each printhead process direction to within 1200 dpi. The appropriate correction factor is applied to the printhead in the process direction regardless of the number of passes or the size of the printhead advance in the non-process direction. Yet another example would be a 1200 dpi head used to print 1200×1200 dpi in one or more passes. Corrections are made to correct for drop position errors in the same manner.

The ability to control ink droplet discharge occurrences in such an addressable system reduces drop placement errors from an expected forty microns or greater to plus or minus four microns in the high addressability direction. In addition, the reduction in intercolor bleed that can be realized is also advantageous. For example, a system utilizing no ink droplet position compensation generates overlaps between colors varying by more than one pixel. The same printhead that compensates for ink droplet position errors generates variations in overlap between colors only fractions of a pixel, a significant improvement. Further, image forming systems utilizing a bi-directional printhead are especially benefited from this invention, because the compounded ink droplet placement errors that occur in opposing directions, that is left to right and right to left printhead directions, are also reduced. Moreover, stationary printheads, both half page width and full page width, are able to benefit from this method to correct for droplet placement errors that are caused by ink droplet placement variations in the system.

In accordance with another aspect of the present invention, an image forming system includes a printhead facility and a processor for controlling the operation of the printhead. The printhead facility is used to provide the processor with ink droplet position compensation values. The processor utilizes the compensation values to regulate or control the discharge of ink droplets from the printhead. As a result, the regulated or controlled discharge of ink droplets from the printhead corrects for the ink droplet placement errors by advancing or delaying the droplets.

In yet another aspect of the present invention, a method for forming an image is practiced in an image forming system having a highly addressable printhead. The method includes discharging ink droplets from the printhead onto an imaging medium to create an image. Differences between a parameter of a first ink droplet and a parameter of a second ink droplet are then measured.

The differences in the measured parameters are then used to control, regulate, vary or adjust the discharge of ink droplets from the printhead. Further, the velocity or drop direction of the first ink droplet discharged from the printhead relative to the velocity or drop direction of the second ink droplet discharged from the printhead is measured, and any differences or variations in the relative velocities or directions between the first ink droplet and the second ink droplet are controlled or compensated in the highly addressable direction. Moreover, based on the measured differences, the errors caused by the tilt of the printhead are compensated for, and one or more ejectors of the printhead are used to normalize the direction and speed of the ink droplets relative to one another. Lastly, the differences in the measured parameters caused by an air gap distance between the printhead and the imaging medium, or time effects, or thermal effects of the printhead may also be used to control, regulate, vary or adjust the discharge of ink droplets from the printhead.

In accordance with an other aspect of the present invention, a method for forming an image with a printhead in an image forming system is performed. First the image forming system discharges a first set of ink droplets and a second set of ink droplets from the printhead. Then differences are determined in spacing between the first set of ink droplets and the second set of ink droplets on the imaging medium. The determined differences are then used to control, regulate, vary or adjust the discharge of the ink droplets from the printhead based on the differences in distance.

In accordance with a further aspect of the present invention, an image forming system includes a printhead, a processor for controlling the printhead, and a printhead facility coupled to the processor for controlling the printhead based on differences between a parameter of a first ink droplet and a parameter of a second ink droplet discharged from the printhead. Based on the differences between the parameter of the first ink droplet and the parameter of the second ink droplet, the processor varies the discharge from the printhead during an imaging operation. Moreover, the parameter differences may include drop position data corresponding to at least one of the first ink droplets and at least one of the second ink droplets. Further, where the printhead includes one or more ink ejectors, the processor in conjunction with the print head facility adjusts one or more of the ink ejectors as a function of the measured parameter differences.

BRIEF DESCRIPTION OF THE DRAWINGS

An illustrative embodiment of the present invention will be described below relative to the following drawings.

DETAILED DESCRIPTION OF THE INVENTION

The present invention provides for a method to correct or compensate for ink droplet placement errors across a printhead or printheads in a printing system. To determine ink droplet position variations across a printhead, an image forming system first forms an image, such as two vertical lines or a rectangular box. Next, the image is examined to determine differences in ink droplet parameters, such as the parallelism of the ink droplets in vertical lines or the parallelism of the rectangular box. From the measured differences in ink droplet parameters a printhead facility determines an ink droplet compensation value for each ink droplet ejector in the printhead.

The ink droplet compensation values determined by the printhead facility are stored within the system, for example, in a look-up table. Thereafter, when an image forming operation is initiated, the printhead facility reads the stored ink droplet compensation values for the identified ejectors and provides the values to the print controller or processor controlling the printhead. As a result, as the data is sorted for printing, adjustments to the ejector firing sequence are made by the processor controlling the printhead based on the provided ink droplet compensation values. Hence, the high velocity ink ejectors of a printhead may be held from firing or advanced in their firing during one or more drop firing cycles to compensate for ink ejectors with droplets that are advanced or retarded in their positions respectively.

In the illustrative embodiment, the image forming system employs a high addressability system, such as an acoustic ink printhead. Nevertheless, one skilled in the art will appreciate that the method practiced by the present invention is applicable to any type of addressable printhead, for example thermal ink printheads, piezo printheads, micromechanical printheads, or electrostatic ink printheads. In addition, the measurement of parameter differences amongst the ink droplets may occur during the manufacturing of the printhead using highly accurate optical measurement techniques. In this manner, for each printhead manufactured and each assembled system, the manufacturer generates an initial ink droplet compensation table on a computer readable medium for later use by the host's printhead facility. In addition, the operator of the image forming system may update the factory provided ink droplet compensation values over a system's life cycle.

Figure 1:
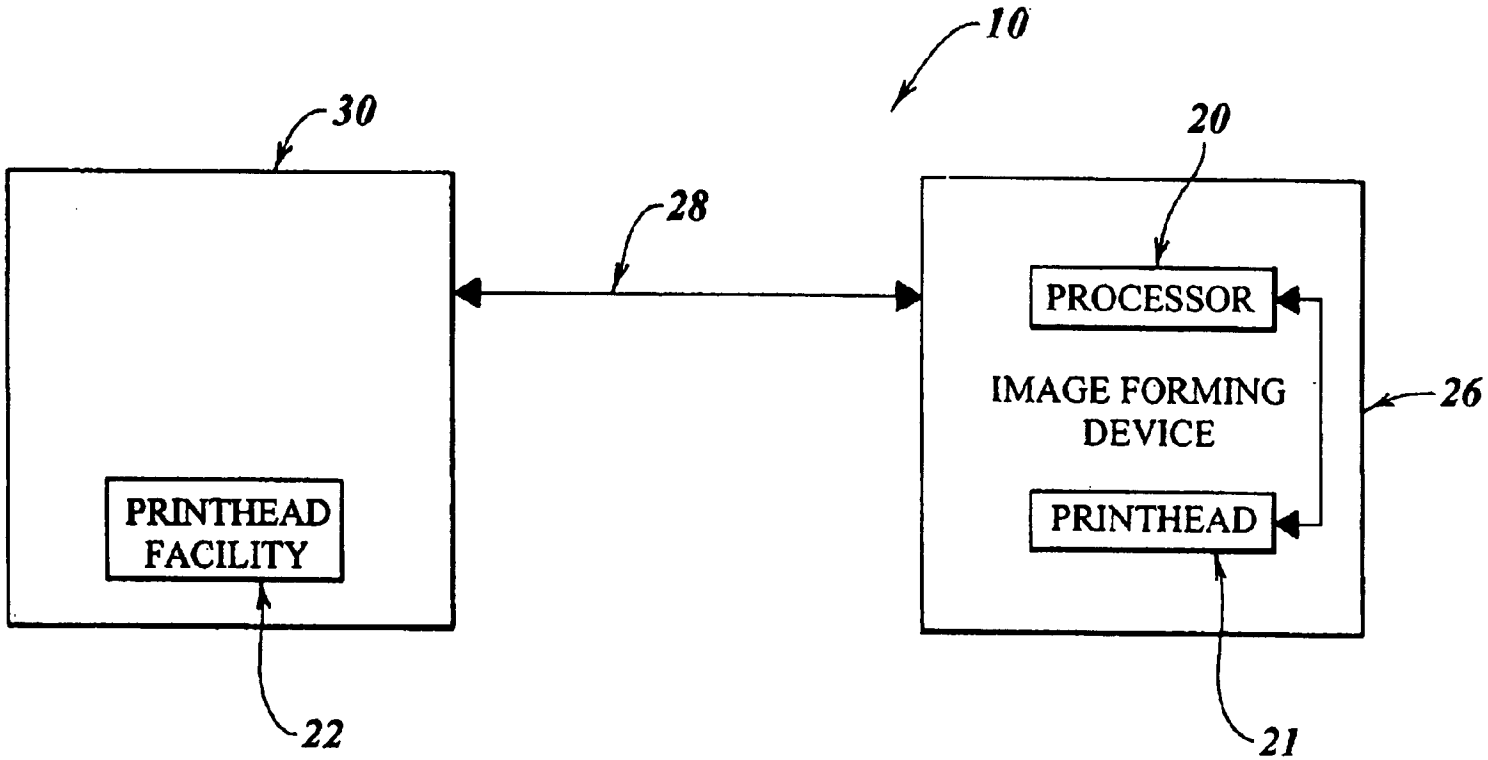
FIG. 1 depicts an image forming system suitable for employing the printhead of the present invention.

FIG. 1 depicts an exemplary image forming system 10 suitable for practicing the present invention. For purposes of the discussion below, an image forming system can include different technologies, such as electrophotographic, electrostatic, electrostatographic, ionographic, acoustic, thermal inkjet, piezo inkjet, micromechanical inkjet and other types of image forming or reproducing systems that are adapted to capture and/or store image data associated with a particular object, such as a document, and reproduce, form, or produce an image.

In the illustrative embodiment, the image forming device 26 is a printer that is highly addressable. The printhead 21 may be an acoustic inkjet printhead, or any other drop on demand printhead, such as an electrostatic inkjet, a piezo inkjet, a micromechanical inkjet, or a thermal inkjet. One skilled in the art will recognize that the present invention is especially advantageous to highly addressable systems due to the higher density of ink droplets per image pixel. In addition, printhead 21 may be a scanning or the system may employ a stationary printhead.

As depicted, the system 10 can employ, according to one practice, a printhead facility 22 that resides within an electronic apparatus 30. The illustrated electronic apparatus 30 may be a desktop computer, a laptop, an image forming system controller, a Personal Digital Assistant (PDA), a wireless communication device such as a wireless telephone, or other suitable electronic device for hosting printhead facility 22. One skilled in the art will appreciate that the electronic host 30 may operate in a network environment, such as a local area network (LAN), wide area network (WAN), Internet, Intranet, extranet, or may be a stand alone device.

The electronic apparatus 30 is in electrical communication with the image forming device 26 via an interconnection cable 28. The interconnection cable 28 may be a serial cable, a parallel cable, a coaxial cable, a fiber optic cable, or the like. Printhead facility 22 can communicate with the processor 20 of the image forming device 26 to control or regulate the firing of the printhead 21 ink ejectors to correct for ink droplet placement errors.

To update the factory provided ink droplet compensation values or to create a set of ink droplet compensation values, the printhead facility 22 directs the processor 20 to create a test image, such as two vertical lines, utilizing the printhead 21 of image forming device 26. Once the image forming device 26 forms the test image on an imaging medium, such as paper stock, the user, utilizing electronic apparatus 30 provides printhead facility 22 with the measured parameter differences in the formed test image. In particular, printhead facility 22 derives from the measured parameter differences provided by the user an ink droplet correction value for each ink droplet in the test image. Parameter differences are rounded to the high addressability of the printhead 21. These parameters may be based on an expected printhead 21 paper gap and may be adjusted accordingly when different media is used. Printhead facility 22 factors into the derived ink droplet compensation values that depend on the effective velocity of individual drops, and stores the appropriate ink droplet compensation values in the system, such as the look-up table.

Figure 2:
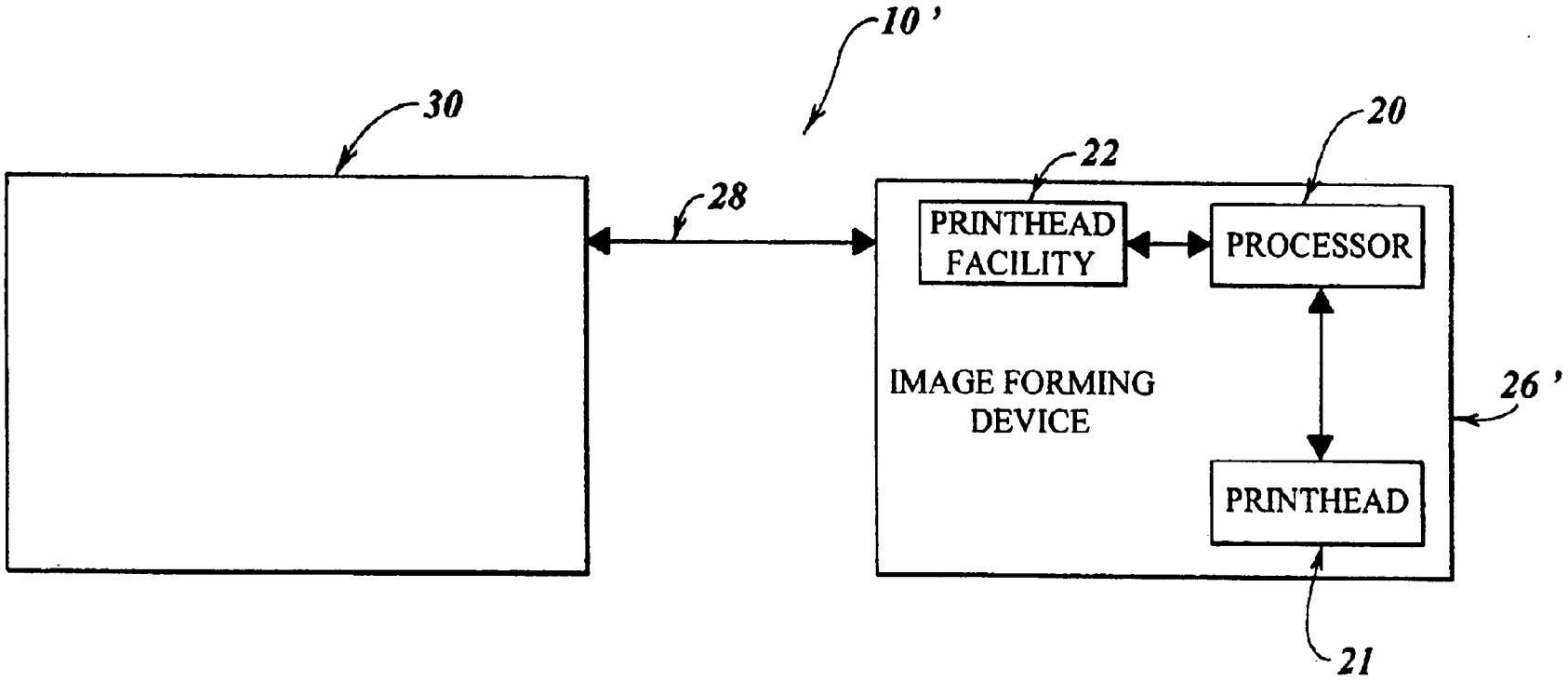
FIG. 2 depicts an image forming system wherein the printhead facility is located at the image forming device.

FIG. 2 represents an alternative embodiment of the present invention where the printhead facility 22 resides with the image forming device 26' of the image forming system 10'. Like reference numbers are used to identify like parts with a superscript prime. In this embodiment, the image forming device 26' may be a remote image forming device in a local area network or may be a local image forming device dedicated to a single electronic apparatus 30. If the image forming device 26' is a remote imaging device in a network environment, one skilled in the art will appreciate that the image forming device 26' is able to form images for more than one electronic apparatus 30, for example five or more electronic hosts.

Figure 3:
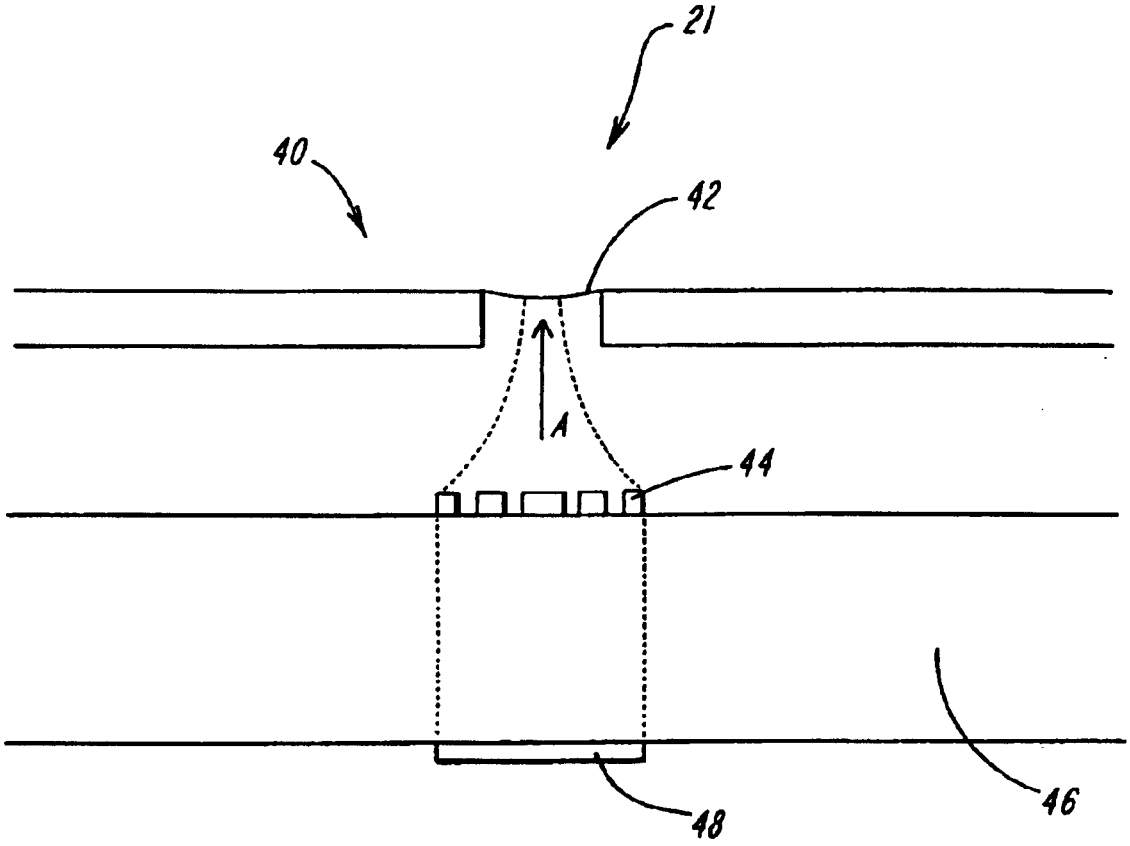
FIG. 3 is a perspective view of an acoustic ink printhead that is suitable for compensating for ink drop position according to the teachings of the present invention.

FIG. 3 shows a single ejector of a printhead 21, which can be, for example, an acoustic ink jet printhead. Typically, the ejector is one of a closely spaced collection of ejectors arranged in either a linear fashion or in a two-dimensional array. Attached to the back surface of substrate 46 of acoustic ink jet 40 is a piezoelectric transducer 48. Formed on the top surface of substrate 46 and covered by a pool of liquid ink, are ink ejectors 44.

In operation, an electric pulse excites piezoelectric transducer 48 to generate a planer acoustic wave that travels in the substrate 46 toward the ejectors 44. When the acoustic waves reach the ejectors 44 at the substrate top surface, the injectors 44 focus the acoustic energy to drive an ink droplet out of opening 42 to impact the recording medium and complete the imaging process.

Figure 4:
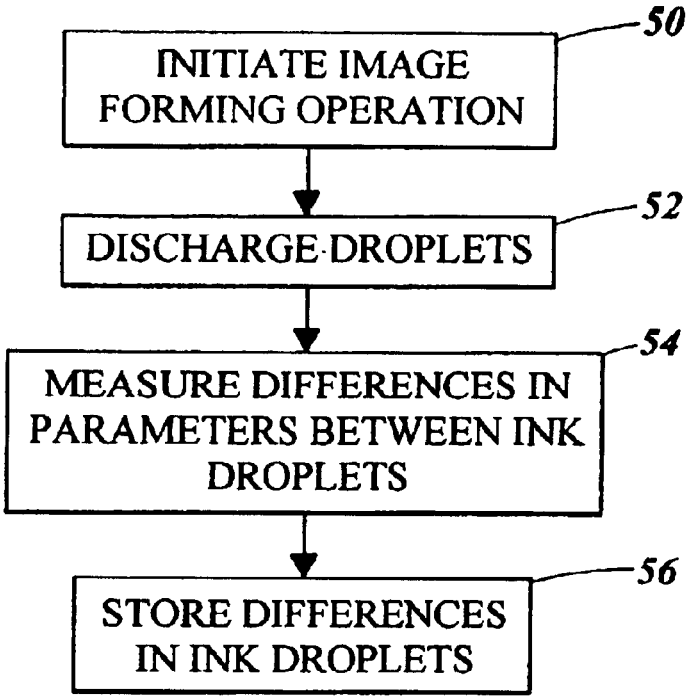
FIG. 4 is a schematic flow chart diagram illustrating steps that are performed to determine ink droplet position variations.

As depicted in FIG. 4, the user of image forming system 10 may create or update the ink droplet compensation factors in printhead facility 22 at any time by initiating an image forming operation to form an appropriate test image (step 50). An appropriate test image may be a rectangular box, or two vertical lines, so that the user has a visual representation of the ink droplet placement errors caused by ink droplet velocity variations across the printhead 21. Once the image forming operation is initiated, printhead facility 22 provides processor 20 with the previously determined ink droplet compensation values, if any, to control or regulate when an ink ejector of the printhead 21 discharges an ink droplet in the image forming operation (step 52).

When the image forming device 26 has completed forming the test image on the imaging medium, the user may remove the imaging medium and measure differences in one or more parameters between the ink droplets of the test image (step 54). The parameter can include any printhead, any individual ink ejector, group of ejectors, or ink characteristic, such as drop volume variations as disclosed by U.S. Pat. No. 5,847,724, which is incorporated by reference herein, deviations from an image overlay, deviations in distance or spacing between the ink droplets, relative errors in drop position, or other like parameters. In addition, the parameters may be adjusted based on the air gap between the imaging medium and the printhead, or as a function over time, or as a function of thermal warming or cooling of any parts of the system.

A user may measure the differences in parameters of ink droplets in a general manner by visually examining the parallelism of the ink droplets forming the test image. As the user is visually examining the parallelism or other quality of the formed test image, the print control facility 22 presents the user with sets of grouped ink ejectors. The ink ejector sets may be grouped by location in the printhead 21 or may be logically grouped based on the factory derived ink droplet compensation values. If the ink ejectors are grouped by ink droplet compensation value, the grouped ink ejectors may be automatically presented to the user in either ascending or descending ink droplet compensation value ranking. For example, the group of ink ejectors identified as having the lowest ink droplet compensation values are presented first and the group of ink ejectors identified as having the highest ink droplet compensation are presented last. In either manner of presenting the ink ejector sets, the user may use the cursor keys of a keypad to increase or decrease the ink droplet compensation value assigned to a selected set of ink ejectors by a constant value.

One skilled in the art will recognize that keyboard keys other than the cursor keys may be assigned a constant value by the printhead facility 22 so that selection of a particular key increases or decreases the ink droplet compensation values of a selected set of ink ejectors by a constant value. In addition, one skilled in the art will also appreciated that a user may increase or decrease the ink droplet compensation values by using a pointing device such as a mouse to select an appropriate icon or graphical user interface element.

An alternative to the general manner of measuring differences in parameters of ink droplets, the user may use some type of measuring device such as ruler, or for even greater precision an optical measuring device, to measure differences in ink droplet parameters. In this manner, the user may also utilize the above-described method for creating or adjusting the ink droplet compensation values.

Once the user provides feedback on the differences between parameters of ink droplets in the test image, the printhead facility 22 adjusts the ink droplet compensation values accordingly and stores the adjusted values as a file in a storage device of the electronic apparatus 30 (step 56). Consequently, the printhead facility 22 provides the processor 20 with the updated ink droplet compensation values whenever an image forming operation occurs. One skilled in the art will recognize that the compensation values may be utilized to control, vary, adjust, or compensate for other printhead parameters, such as printhead tilt, ink droplet direction, and ink droplet speed.

Figure 5:
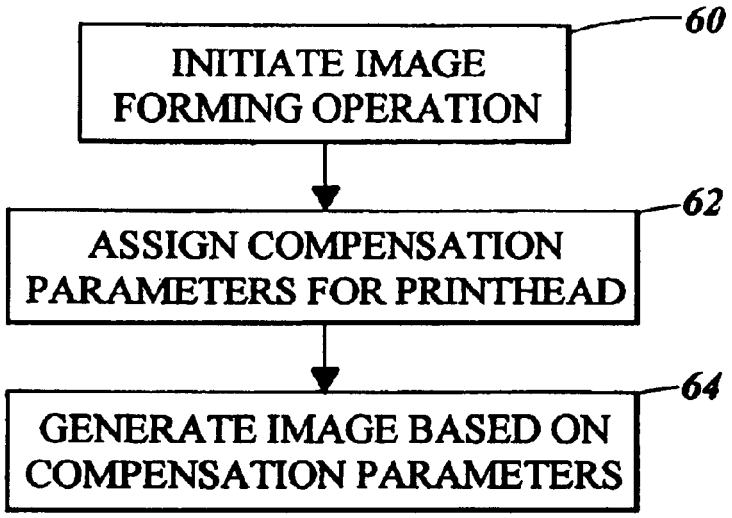
FIG. 5 is a schematic flow chart diagram depicting the steps that are performed when compensating for ink droplet position variations.

As illustrated in FIG. 5, when a user initiates an image forming operation (step 60) the printhead facility 22 accesses the ink droplet compensation values stored in the look-up table and provides the processor 20 with the ink droplet compensation values (step 62). Based on the provided ink droplet compensation values, the processor 20 regulates or controls the printhead 21 of the image forming device 26 to discharge ink droplets at the appropriate times to correct for ink droplet placement errors caused by ink droplet placement errors (step 64). One skilled in the art will recognize that because of the ink droplet compensation value is rounded to the addressability of the system, there are positions across the printhead 21 where the ink droplet compensation values result in a delayed ink ejector firing or an advanced ink ejector firing.

While the present invention has been described with reference to the above illustrative embodiments, those skilled in the art will appreciate that various changes in form and detail may be made without departing from the intended scope of the present invention as defined in the appended claims. For example, the printhead 21 of the image forming device may be an acoustic ink printhead, a piezo printhead, a micromechanical printhead, or a thermal ink printhead. In addition, the processor controlling the printhead 21, such as a print controller, may reside within the image forming device or outside the image forming device at a remote location, such as, a print server or other suitable remote electronic host.

What is claimed is:

1. In an image forming system, a method of forming an image with a printhead, the method comprising the steps of:

forming sets of grouped ink ejectors, the groupings determined based on previously entered ink droplet compensation values;

discharging a first set of ink droplets and a second set of ink droplets from the printhead onto a print medium to form an image;

determining differences in distance between the first set of ink droplets and the second set of ink droplets once deposited on the print medium;

presenting the grouped ejectors to a user in one of ascending and descending droplet compensation value ranking;

updating, by the user, compensation values for a selected set of ink ejectors by a constant value based on the determined differences between the first set of ink droplets and the second set of ink droplets; and controlling a subsequent discharge of the ink droplets from the printhead based on the updated compensation values.

2. The method of claim 1, wherein the step of determining the differences in distance between the ink droplets of the first set and the ink droplets of the second set further comprises the step of determining an air gap distance between the imaging medium and the printhead.

3. The method of claim 1, further comprising the step of characterizing the printhead to determine velocity variations in ink droplets, and scheduling the discharge of the ink droplets based on the printhead characterization.

* * * * *